US009697723B1

(12) United States Patent
Ladanyi et al.

(10) Patent No.: US 9,697,723 B1
(45) Date of Patent: Jul. 4, 2017

(54) ILLUMINATED DOORBELL TOUCH PAD SYSTEM

(71) Applicant: LITEX INDUSTRIES, LIMITED, Grand Prairie, TX (US)

(72) Inventors: Donald J Ladanyi, Westlake, OH (US); Georgios V Lazaridis, Piraeus (GR)

(73) Assignee: Litex Industries, Limited, Grand Prairie, TX (US)

( * ) Notice: Subject to any disclaimer, the term of this patent is extended or adjusted under 35 U.S.C. 154(b) by 0 days.

(21) Appl. No.: 14/598,220

(22) Filed: Jan. 15, 2015

Related U.S. Application Data

(60) Provisional application No. 61/927,975, filed on Jan. 15, 2014.

(51) Int. Cl.
*G08B 25/08* (2006.01)
*G08B 29/18* (2006.01)
*G08B 7/06* (2006.01)

(52) U.S. Cl.
CPC ..... *G08B 29/185* (2013.01); *G08B 7/06* (2013.01)

(58) Field of Classification Search
CPC ..... G08B 29/02; G08B 7/06; H04M 11/02
USPC ..... 340/692, 326, 328, 330, 815.7, 392.4; 200/310
See application file for complete search history.

(56) References Cited

U.S. PATENT DOCUMENTS

| | | | | |
|---|---|---|---|---|
| 7,429,924 | B2 * | 9/2008 | Langer | G08B 3/10 340/384.1 |
| 2007/0008077 | A1 * | 1/2007 | Claiborne | G08B 3/10 340/330 |
| 2015/0054949 | A1 * | 2/2015 | Scalisi | H04N 7/188 348/143 |
| 2015/0109112 | A1 * | 4/2015 | Fadell | G08B 27/003 340/328 |
| 2015/0156031 | A1 * | 6/2015 | Fadell | H04L 12/2816 700/276 |

* cited by examiner

*Primary Examiner* — Phung Nguyen
(74) *Attorney, Agent, or Firm* — Mark W Handley

(57) ABSTRACT

An illuminated doorbell touch pad system is disclosed, having a chime control unit controlled by a micro-processor which continually calibrates according to a process for discriminating between a human touch and moisture, rain and small animals, for changes in capacitance of a metal housing enclosing an outdoor portion of the illuminated doorbell touch pad system.

17 Claims, 8 Drawing Sheets

ILLUMINATED DOORBELL TOUCH PAD SYSTEM

CROSS-REFERENCE TO RELATED APPLICATION(S)

The present application claims priority to U.S. Provisional Patent Application Ser. No. 61/927,975, filed Jan. 15, 2014, entitled Illuminated Doorbell Touch Pad System, and invented by Donald J. Ladanyi and Georgios V. Lazaridis.

TECHNICAL FIELD OF THE INVENTION

The present invention relates in general to doorbell chimes, and in particular to a doorbell chime having a capacitive touch pad system.

BACKGROUND OF THE INVENTION

Prior are doorbell chimes have been provided using discrete components to provide relays and switching circuits for controlling the doorbell chimes. Some doorbell chimes have been provided with illuminated chime housings also using discrete components. Typically, a control voltage is applied to a doorbell push button switch. Actuating the push button switch applies power to a chime coil which rings the chime. Relay circuits have also been used to apply a control voltage to a relay which results in a power voltage being applied to ring the chime. Touch sensors have also be used for actuating doorbell chime systems, but are often set off by environmental conditions causing false doorbell rings.

SUMMARY OF THE INVENTION

An illuminated doorbell touch pad system is disclosed, having a chime control unit controlled by a micro-processor which continually calibrates according to a process for discriminating between a human touch and moisture, rain and small animals, for changes in capacitance of a metal housing enclosing an outdoor portion of the illuminated doorbell touch pad system.

DESCRIPTION OF THE DRAWINGS

For a more complete understanding of the present invention and the advantages thereof, reference is now made to the following description taken in conjunction with the accompanying Drawings which show various aspects for an illuminated doorbell touch pad system according to the present invention, as set forth below.

DETAILED DESCRIPTION OF THE INVENTION

Figure 1:
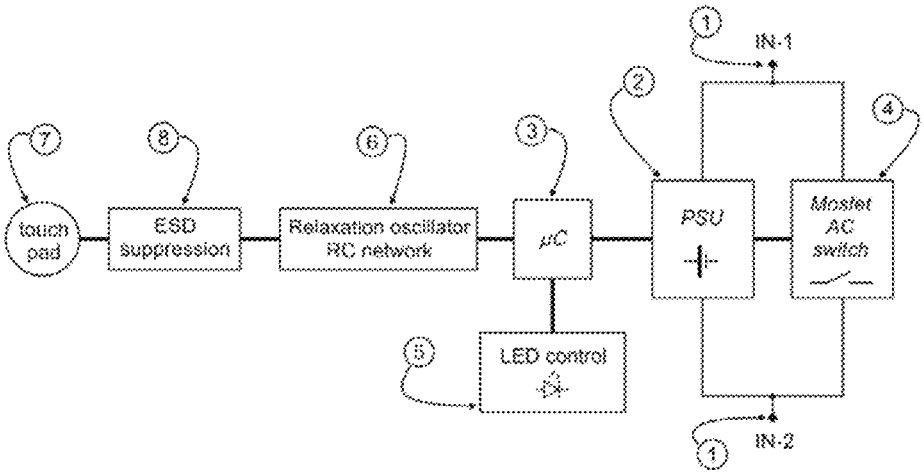
FIGS. 1-3 are circuit diagrams.

Referring to FIG. 1, the wires of the chime button installation are connected at the IN-1 IN-21 terminals of the IDTPS. A Power Supply Unit 2 is responsible to rectify, smooth and regulate the input voltage and provide DC voltage for the microcontroller 3, the MOSFET AC switch 4 and the illumination LEDs 5.

The touch sensor is based on the Frequency-Change touch sensing technique. The microcontroller's 3 internal comparator is used to perform a relaxation oscillator with the help of an external RC network 6. The oscillator oscillates at a pre-determined frequency based on the values of the resistor R and the capacitor C of the RC network. The metallic part of the housing performs the touch electrode (touch pad) 7. When the touch electrode 7 is touched, the human body capacitance is added in parallel to the capacitor C of the RC network 6 effectively changing the overall capacitance of the RC network. This capacitance change leads to a frequency change of the relaxation oscillator. The microcontroller 3 is able to sense this frequency change by continuously measuring the oscillation frequency and comparing it every time with a pre-determined threshold frequency. If the current frequency falls below this threshold frequency, the microcontroller 3 recognizes a human touch. To protect the sensitive input of the microcontroller 3 from extreme Electro-Static Discharge (ESD), an ESD suppression circuitry 8 is used.

Figure 2:
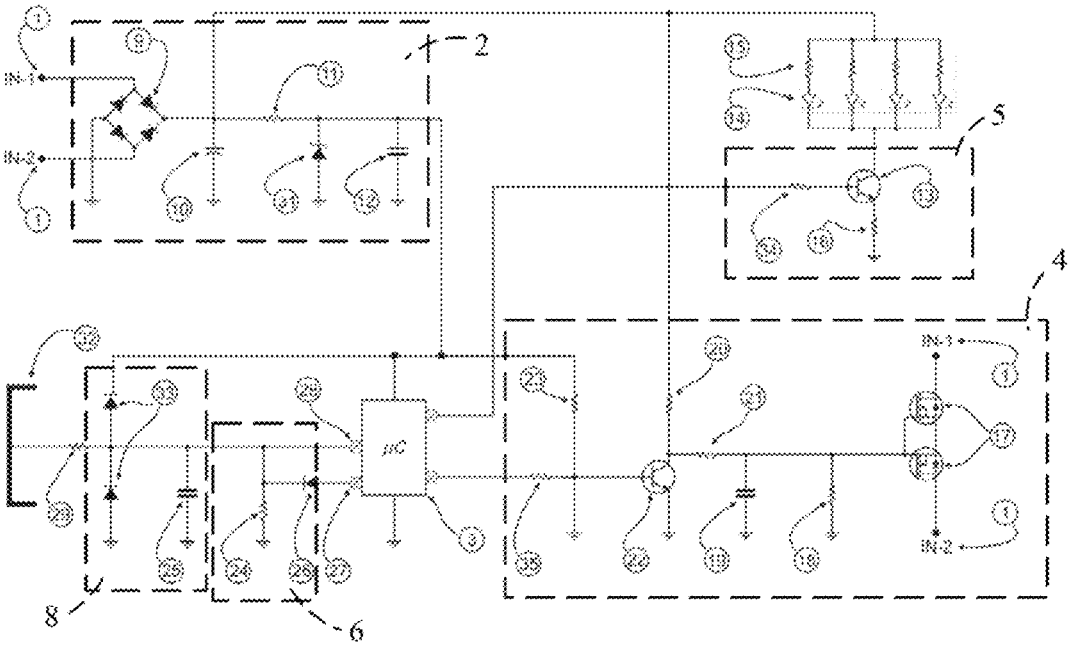

Referring to FIG. 2, a bridge rectifier 9 rectifies the AC voltage input 1 and an electrolytic capacitor 10 smooths the DC rectified output. A resistor 11 and a Zener diode 31 are used to regulate the 5 Volts required for the circuit operation. A small ceramic capacitor 12 is placed close to the microcontroller's 3 power supply to filter out any higher frequency noise.

A typical single-transistor 13 constant current driver is used to supply the required current for the four LEDs 14. Each LED has a balancing resistor 15 to balance the current through each of the four LED branches. The overall current through all four branches is set by the emitter resistor 16. The device is set to allow approximately 50 mA of current through, enough to brightly illuminate the housing with the four LEDs, but not high enough to stress or actuate the solenoid of the chime bell.

A dual anti-serial MOSFETs 17 circuit performs the AC switch. The gates of the two MOSFETs are pulled low with a pull-down resistor 18. A small ceramic capacitor 19 along with the collector resistor 20 generates a delay to avoid accidental triggers upon power up or after recovering from a power failure. A small resistor 21 protects the delay capacitor 19 from high discharge currents through the transistor 22.

The gates of the two MOSFETs 17 are controlled by a transistor 22. As long as the base of the transistor is pulled high with a pull-up resistor 23, the transistor operates in the saturation area and the gates of the MOSFETs 17 are kept LOW keeping the MOSFET switch OPEN. The resistor 35 provides a base bias to the transistor 22. One end of the resistor 35 is connected to the microcontroller 3, such that the resistors 23 and 35 together provide a voltage divider for applying a selected voltage high or low voltage to the transistor 22 as determined by operation of the microcontroller 3.

An active LOW at the gate of the transistor 22 from the microcontroller 3 puts the transistor into the cut-off area. The gates of the two MOSFETs 17 are then driven HIGH effectively CLOSING the AC switch allowing current to run through, actuating the chime solenoid.

The touch sensor is based on the Frequency Change method. The internal comparator module of the microcontroller 3 along with a resistor R 24 and a capacitor C 25 perform a relaxation oscillator. The capacitor C 25 is rapidly charged through a blocking diode 26 from the output of the microcontroller's comparator 27. The non-reversing input of the microcontroller's comparator 28 tests the voltage of the capacitor 25. When the capacitor 25 is fully charged, the output of the comparator 27 is driven LOW. The blocking diode 26 blocks current to flow from the capacitor 25 back to the output of the comparator 27, therefore the capacitor 25 slowly discharges through the resistor 24. When the capacitor 25 is discharged to about 0.6V, the output of the comparator 27 is turned HIGH again and the cycle repeats. The comparator is internally coupled with a timer module used by the microcontroller 3 to measure the oscillation frequency.

The metallic part of the housing performs the touch pad 32. To protect the sensitive input of the microcontroller 3 from Electro-Static Discharge ESD, two clamping diodes 33 and a limiting resistor 29 are used. The resistor reduces the inrush current of the ESD and the two clamping diodes ensures that anything above or bellow the acceptable voltage levels will not go through the microcontroller 3.

When the touch pad 32 is touched, the human body capacitance is effectively added in parallel to the capacitor C 25, thus increasing its capacitance. This capacitance increment changes the oscillation frequency of the relaxation oscillator described before. More specifically, the frequency is decreased. The microcontroller 3 continuously checks the oscillation frequency and compares it with a pre-determined threshold value. If the oscillation frequency falls bellow this threshold value, the microcontroller recognizes a touch.

When a touch is recognized, the LED current driver 5 is turned off. Then the transistor base 22 of the MOSFET switch 4 is driven LOW for a period of time. The gates of the two MOSFETs 17 are driven high effectively CLOSING the AC switch to actuate the chime solenoid.

When the microcontroller 3 recognizes a touch, the MOSFET AC Switch 17 is NOT kept closed for as long as the touchpad 32 is touched. Instead, the MOSFET AC Switch 17 is closed only for a period of time of a few hundreds milliseconds sending only a pulse to actuate the chime solenoid. This way, a smaller electrolytic capacitor 10 can be selected, effectively reducing the overall cost and size of the device.

When the microcontroller 3 recognizes a touch, the MOSFET AC Switch 17 is CLOSED for a period of time thus allowing current to run through the MOSFETs 17. But this means that there is no voltage across the PSU 2 for as long the MOSFETs 17 conduct current. To maintain power across the microcontroller 3, there is a large electrolytic capacitor 10. The capacitor 10 stores energy when the tough pad 32 is not touched. The capacitor 10 will store enough energy to provide power to the microcontroller 3 when the MOSFET AC Switch 17 is closed. This way the microcontroller 3 does not reset due to brown out or power failure.

When the microcontroller 3 recognizes a touch, it first turns completely off the LED Current Driver. No power is consumed for the Current Driver or the LEDs 14 for as long the MOSFET AC Switch 17 is closed. This way the electrolytic capacitor 10 is able to maintain sufficient power for the microcontroller 3 during this time, otherwise the LEDs 14 would quickly drain all the power from the capacitor 10 turning completely off the microcontroller 3.

A delay circuit provided by an RC Network comprised of Resistors (R) 20, 21 and a capacitor (C) 19 keeps the MOSFET gates LOW for a short period of time when the device is powered ON or revives after a brown-out or power failure. This is done because the output of the microcontroller 3 cannot be controlled for a short period of time when the microcontroller 3 revives from a reset. It could accidentally close the MOSFET AC Switch 17 which will eventually actuate the chime solenoid. The delay RC network 19, 20, 21 ensures that the microcontroller 3 has enough time to initiate before the MOSFET gates can be driven HIGH.

A constant current driver 5 comprised of a single transistor 13 is used to control the LED current to the LEDs 14 instead of a simple limiting resistor. The first advantage of using the single current driver 5 is that the LEDs 14 can be indirectly controlled by the microcontroller 3 drawing only a few microamperes when the driver 13 is turned OFF, allowing thus a smaller capacitor 10 to be used. A second advantage is that the IDTPS can effectively control the maximum current that will flow through the chime installation regardless of the chime installation voltage, extending therefore the operating voltage range of the IDTPS. A third advantage of use of a the current driver 5 over a limiting resistor is that the brightness of the LEDs 14 is maintained the same regardless of the operating voltage.

The transistor 13 chosen for the LED driver 5 has a high power dissipation capacity (600 mW). With properly designed copper thermals on the PCB for a heat sink, the device is able to dissipate all the power needed when it is called to operate at higher voltage than 16 VAC.

Two clamping diodes 33 and one inrush limiting resistor 29 ensures that the device can stand the extreme ESD that will be experienced from human bodies wearing woolen clothes touching touch pad 32.

The current configuration provides zero-force actuation for a chime bell touch button using capacitive touch technology to sense a touch. The device is sensitive enough to sense a touch through a glove or other clothing, from any part of the human body making it user friendly for handicap people. When a touch is sensed only one short pulse is generated to ring the chime bell, such that the chime bell circuit including the transformer and the chime bell are protected from overload as could happen from a jammed chime button. The device has a metallic housing, a metallic base and a printed circuit board ("PCB"). The metal housing provides the touch pad, and it has an electrically-insulating layer to protect the sensitive electronics from Electro-Static Discharge ("ESD"). The metal housing is preferably is fixed to the metallic base with one screw which is used to electrically connect the metallic housing with the metallic base. The is fixed on the metallic base with a plurality of screws which electrically connect the PCB touch terminals with the metallic base. Mounted to the PCB are a microcontroller, a large capacitor, a mosfet AC switch, a plurality of LEDs and a plurality of the other electronic parts described herein. A large capacitor is charged from the chime bell circuit. When the device is not touched, the microcontroller is powered from the chime bell circuit. When the device is touched, the microcontroller and the mosfet AC switch are powered from the large capacitor for the duration of the ring-pulse. When the device is not touched, the LEDs are bright to indicate the chime button. When the device is touched, the LEDs are automatically turned off to drop down the power consumption from the large capacitor.

Figure 3:
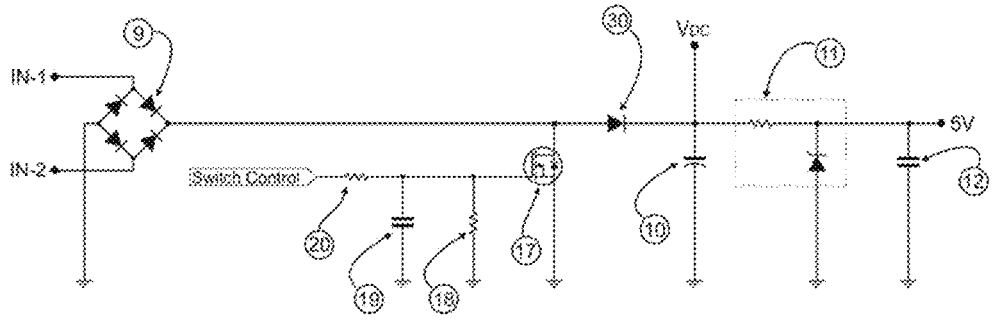

Referring to FIG. 3, a more cost-effective MOSFET AC switch circuit is shown. The switch circuit can be implemented between the bridge rectifier 9 of the PSU 2 and the DC voltage outputs, using only one MOSFET 17 instead of the two anti-serial MOSFETs 17 shown in FIG. 2. An extra decoupling diode 30 is required to decouple the electrolytic capacitor 10 form the AC switch when the switch is CLOSED. A pull-down resistor 18 ensures that the gate of the MOSFET 17 is kept LOW during power up. A delay circuit composed by a small capacitor 19 and a resistor R 20 ensures the MOSFET 17 will not accidentally fire after power up, brown out or if the circuits recovers after a power down, until the microcontroller 3 is fully initialized. When the microcontroller 3 recognizes a touch, current runs through the bridge rectifier 9 and then through the MOSFET 17, effectively actuating the chime solenoid.

Figure 4:
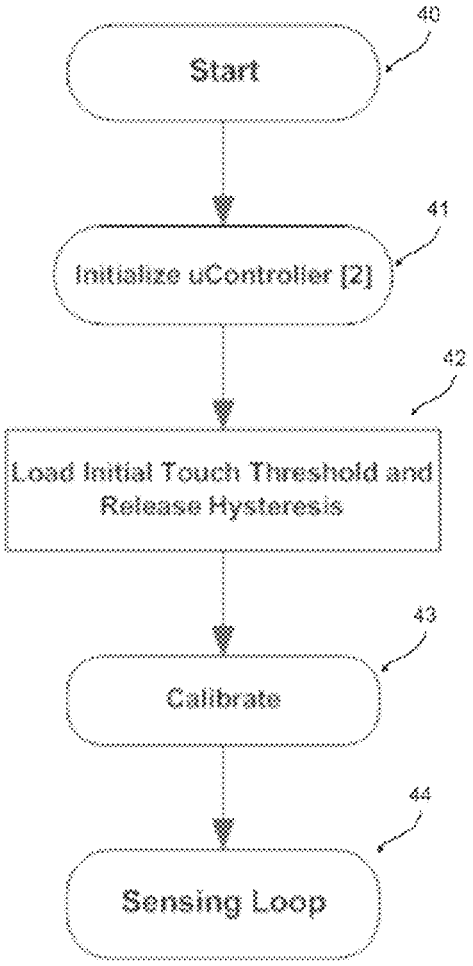
FIGS. 4-10 are flowcharts showing a process for operating in a microprocessor controlling the system for storing settings in memory and operating the microprocessor to continually calibrate a capacitance of a touch surface to discriminate a human touch from moisture, small animals and other type environmental contacts.

FIGS. 4-10 are flowcharts showing a process for operating in the microprocessor 3 for controlling the system, storing settings in memory and operating the microprocessor 3 to continually calibrate a capacitance of a touch surface to discriminate a human touch from moisture, small animals and other type environmental contacts. Referring to FIG. 4, when powered up, the system Starts in step 40 and runs an Initialization routine 41 to set up the registers, RAM positions, inputs and outputs. The system will then load a predetermined set of parameters for the Touch Threshold and the Release Hysteresis in step 42. Next the system will run the Calibration Routine in step 43 during which it will determine the current oscillation frequency and it will try to set the optimum oscillation frequency. When done the pointer jumps to the Sensing Loop in step 50.

Figure 5:
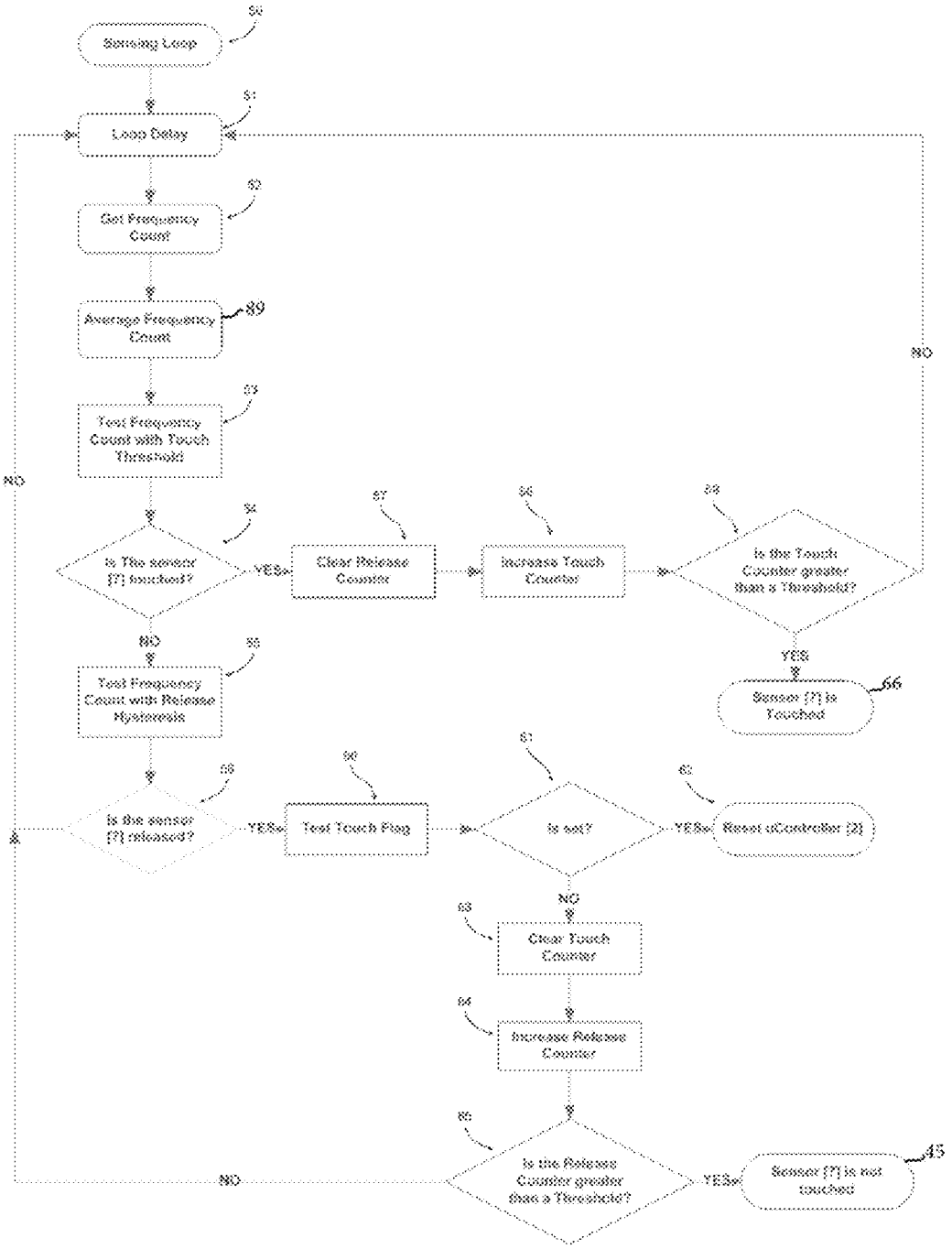

Referring to FIG. 5, the Sensing Loop in step 50 operates to loop continuously until a touch or release condition is detected. Immediately after entering the Sensing Loop in step 50 a specific short delay is executed in step 51. Then in step 52 the system will acquire the current frequency count of the capacitance oscillator applied to the inputs 28 and 27 of the microprocessor 3. This frequency depends on the resistor R 24 and the capacitor C 25 of the RC network, and the capacitance of the touch pad 32. When the frequency is acquired, the system will Average this Frequency Count in step 89. Then the process in step 53 will test the current frequency with the Touch Threshold and decide whether the sensor is touched in step 54. If in step 54 a determination is made that the sensor is touched, the process will move to step 57 and will clear the Release Counter and then in step 58 will increase the Touch Counter 58. Then the process moves to step 59 and determines whether the Touch Counter is greater than a specific threshold, if so, in the process moves to step 59*b* and considers the touch pad 32 as being touched and will jump to step 66 in FIG. 7. If in step 69 a determination is made that the touch pad 32 is not being touched, the process will return to the Loop Delay and repeat step 51. If in step 54 a determination is made that the sensor 32 is not being touched, then the system proceed to step 55 and test the current frequency with the release hysteresis. If the system decides that the sensor 32 is not released, it will return to the Loop Delay of step 51. If not, the system will proceed to step 60 and test the Touch Flag. If the Touch Flag is set, this means that the sensor is released after being touched and the system will proceed to step 62 and reset the microprocessor 3. Otherwise the system will proceed to step 63 and will clear the Touch Counter and then in step 64 increase the Release Counter 64. Then the system will proceed to step 65 to test the Release Counter. If in step 65 a determination is made that the release counter greater than a specific threshold the system considers that the sensor is not touched and will jump to step 45 in FIG. 6. Otherwise the system will proceed to the Loop Delay step 51.

Figure 6:
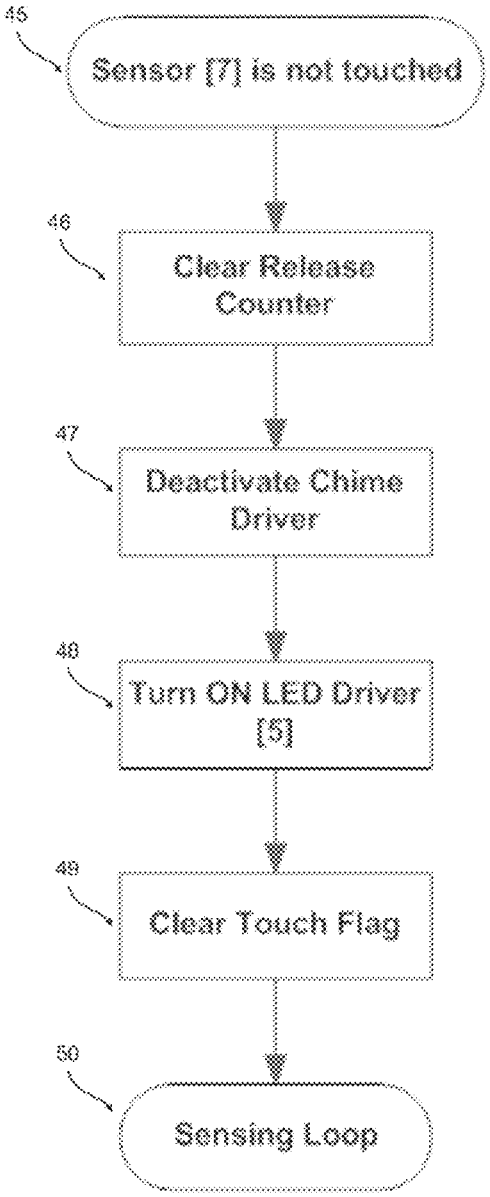

Referring to FIG. 6, from step 45 the process will first clear the Release Counter in step 46 and then will deactivate the Chime Driver in step 47 in case it was activated. The process will then turn ON the LED Driver in step 48 to ensure that thee LEDs 14 are lit. Then it will clear the Touch Flag in step 59 and in step 50 will return to the process of FIG. 6.

Figure 7:
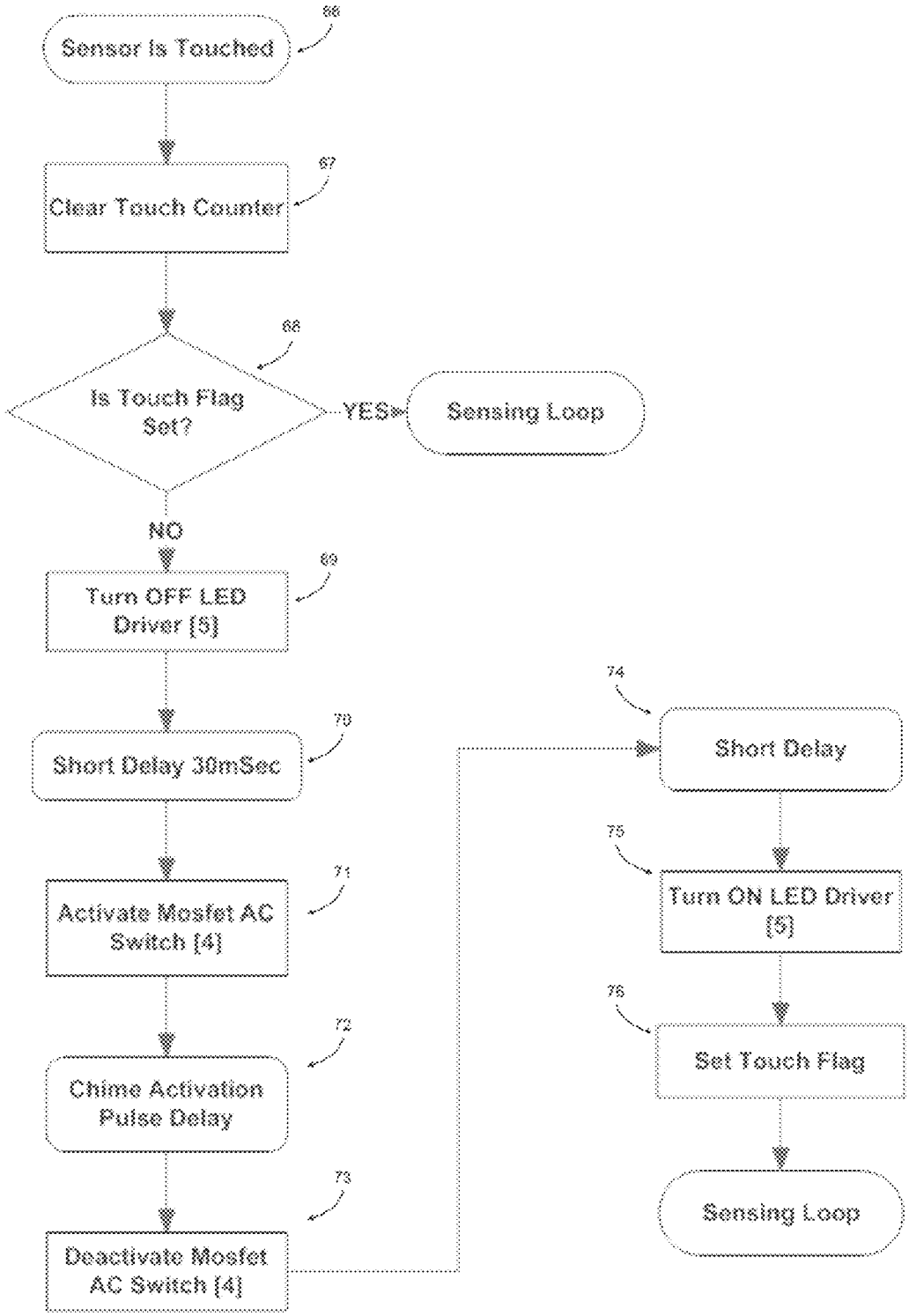

Referring to FIG. 7, when in step 59 of FIG. 5 a determination is made that the sensor pad 32 is touched, the process will move to step 66 in FIG. 7 and then in step 67 will clear the Touch Counter. It will then test the Touch Flag in step 68 by determining whether the Touch Flag is set. If the Touch Flag is set this means that the sensor 32 was already touched so the system will return to the Sensing Loop of step 50 in FIG. 5. If in step 68 a determination is made that the Touch Flag was not set, the process will proceed to step 69 and first turn OFF the LED Driver 69. The process will then in step 70 remain idle for a short delay period of 30 mSec 70 and in step 71 will send a pulse to the chime solenoid by activating the mosfet switch 17 in step 71. The process will then wait in step 72 for a duration of time and deactivate the mosfet switch in step 73. The process will wait in step 74 for a short delay, then in step 75 will turn ON the LED Driver 5, and then in step 76 will set the Touch Flag 78. The processing will then return to the Sensing Loop step 50 of FIG. 5.

Figure 8:
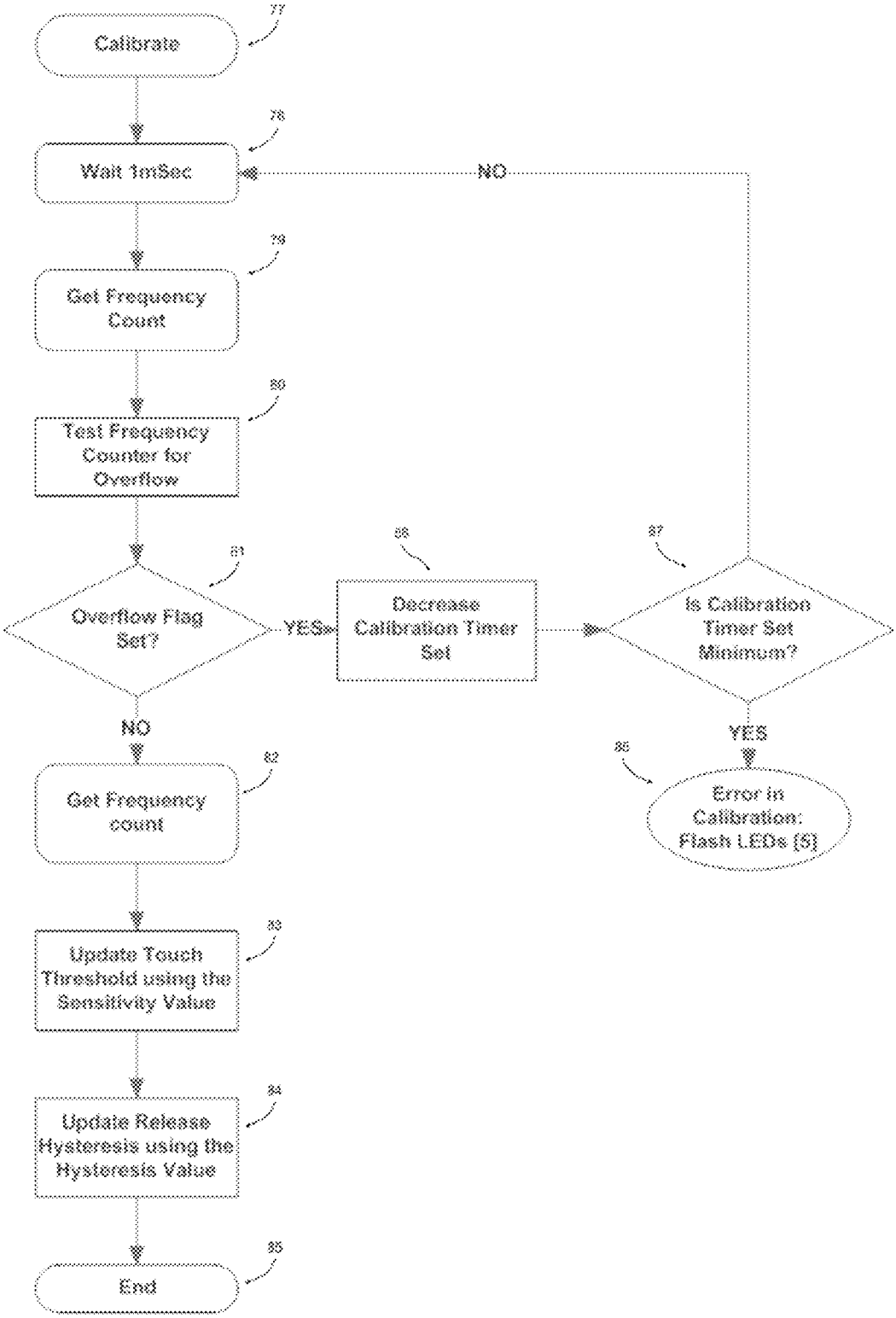

Referring to FIG. 8, the calibration step 43 of FIG. 4 is depicted. In step 77 the Calibration routine is initiated. The Calibration routine will test different timer settings to decide what is the optimum setting for a specific touch pad 32. In step 78 a 1 mSec delay 78 pause occurs for the program flow to allow the oscillator circuit 6 to settle. Then in step 79 a frequency count is acquired and then in step 80 the frequency counter is tested for an overflow. If in step 81 a determination is made that the frequency counter overflowed, the system will move to step 86 and decrease the timer setting. The system will then test the timer setting in step 87. If the timer setting has reached a minimum setting then the system cannot calibrate the sensor and it will flash the LEDs to indicate the error in 88, otherwise the system will return back to the 1 mSec delay of the calibration routine in step 78. If in step 81 a determination is made that the frequency counter has not overflowed then the system will acquire once more the current frequency in step 82. The process will then use the Sensitivity Value to get the Touch Threshold from the current frequency count in step 83 and it will use the Hysteresis Value to get the Release Hysteresis from the current frequency count in step 84. The process will end in step 85 and return to the step 44 in FIG. 4, which then proceeds to the step 50 in FIG. 5.

Figure 9:
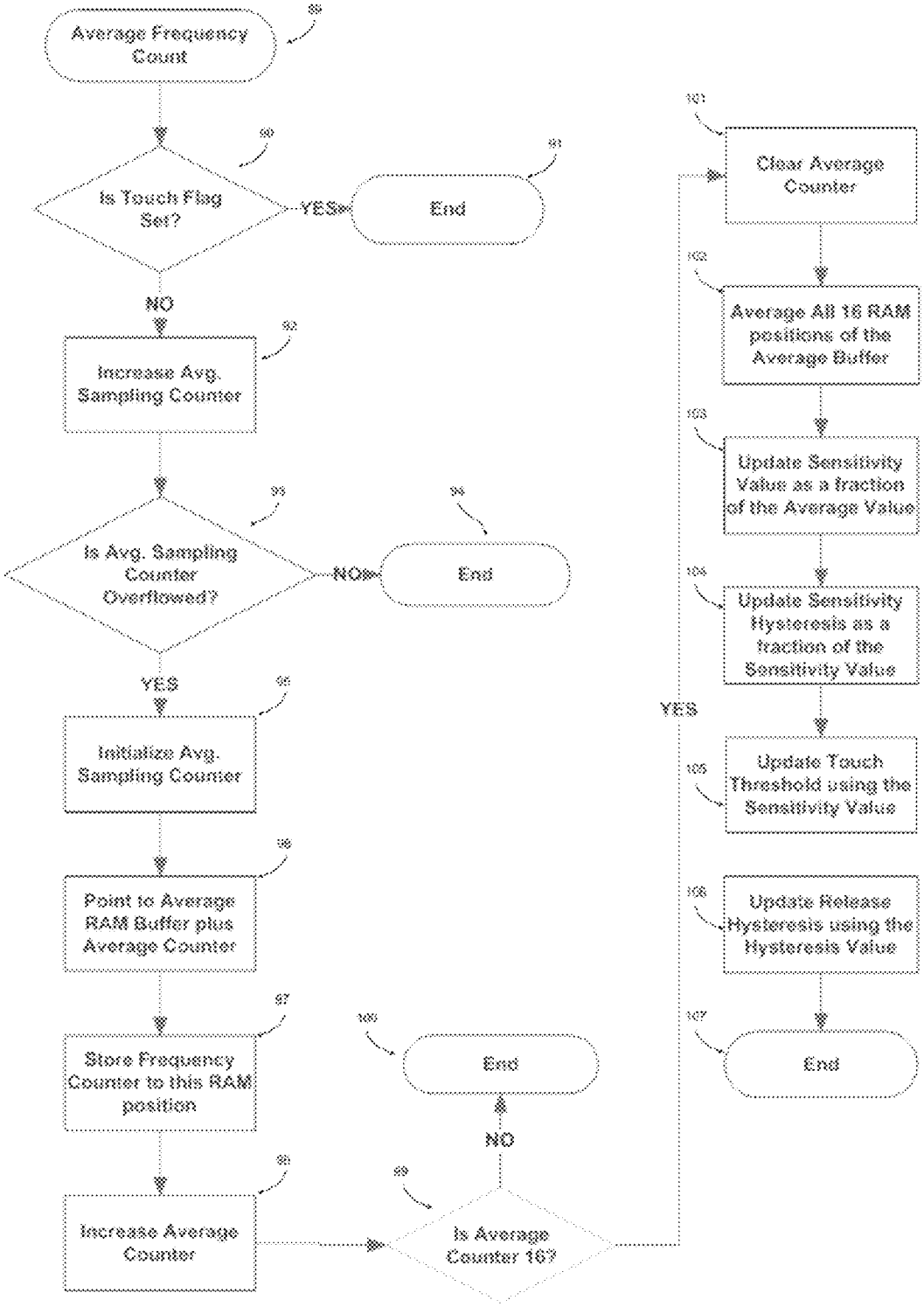

Referring to FIG. 9, the Average Frequency Count routine of step 89 of FIG. 5 is depicted. This routine averages 16 frequency counts. The result then is used to dynamically recalibrate the sensor. The routine starts by testing the Touch Flag to see if the sensor is touched step 90. If the sensor is touched then the routine ends in step 91, and returns to step 53 in FIG. 5. If the sensor is not touched then the Averaging Sampling Counter is increased by one in step 92. If the Averaging Sampling Counter is not overflowed then the routine ends step 94 and returns to step 53 in FIG. 5. Otherwise the routine proceeds by re-initializing the Averaging Sampling Counter for the next calls in step 95. Then the system sets a pointer to a specific RAM address and adds the Average Counter in step 96. Then the process stores the current frequency count to this RAM address in step 97 and increases the Average Counter in step 98. The process then tests the Average Counter in step 99 and if the Average Counter is less than 16 the routine ends in step 100 and returns to step 53 in FIG. 5. Otherwise this means that a total of 16 counts are stored into the RAM buffer. The system clears the Average Counter in step 101 to prepare the Average Counter for the next calls. Then the process averages all 16 RAM positions in step 102 by adding them all together to a 16-bit register and then divides this register by 16. Using this average the system extracts a new Sensitivity Value as a fraction of the Average Value in step 103. Next the process extracts the new Sensitivity Hysteresis as a fraction of the Sensitivity Value previously noted in step 104. Then the process uses these two new values to update the Touch Threshold using the Sensitivity Value in 105 and the Release Hysteresis using the Hysteresis Value in step 106. At that point the Average Frequency Count routine ends 107, and the process returns to step 53 in FIG. 5.

Calibration, Reset after Touch, Hysteresis and recalibration are preformed by averaging detected values. Touch sensors are sensitive by their nature. They operate by sensing the difference in capacitance on a sensor. The size, material and placement of the touchpad alters the quiescence capacitance radically. The calibration routine in step 43 during start-up rapidly tests several frequency divisions to discover which one brings the center frequency (in quiescence) in optimum count so that the sensitivity is kept to maximum. This way different touch pads 32 can be utilized just as effectively. Capacitance touch sensors are also very sensitive to water. Water droplets or frozen moisture alters the capacitance radically. During the normal operation, the system always measures and averages the quiescence frequency a number of times each minute. Whenever a new average frequency arises from this operation the system recalibrates itself to match this new frequency. Therefore, water droplets from rain or frozen moisture which slowly accumulate on the touch pad 32 are compensated and the sensor operates with the new conditions.

Whenever the sensor is touched, it may alter its quiescence frequency afterwords as a result of the physical contact. If for example frost or water has accumulate on the touch pad 32, the operator may wash out this mass by touching the touch pad 32. The averaging routine is not very effective in compensating such rapid changes. Therefore, whenever the sensor is touched and released the system resets itself in step 62. This feature forces the system to rapidly recalibrate with the new conditions. The reset condition after a touch/release in step 62 can potentially bring the system in a low sensitivity operation in some cases. For example if the operator touches the touch-pad 32 but he then removes the finger very slowly, then a reset condition will rapidly calibrate the sensor at a very low sensitivity because it will try to compensate the finger of the operator which is still in the proximity of the sensor. To avoid this situation a hysteresis is introduced. The system recognizes thee conditions instead of two. The first is the touch condition, as a result of a rapid capacitance increment. The second state is the release condition as a result of a rapid capacitance decrement. The third state is the release hysteresis. This state occurs after a rapid capacitance decrement (release condition), but the amount of decrement is bellow the Release Hysteresis in step 55. So, if the operator touches the sensor (Touch Condition) and then tries to confuse the system by retracting the finger very slowly, the system will take no further action until the measured capacitance is less than the capacitance after the touch condition minus the Release Hysteresis.

Figure 10:
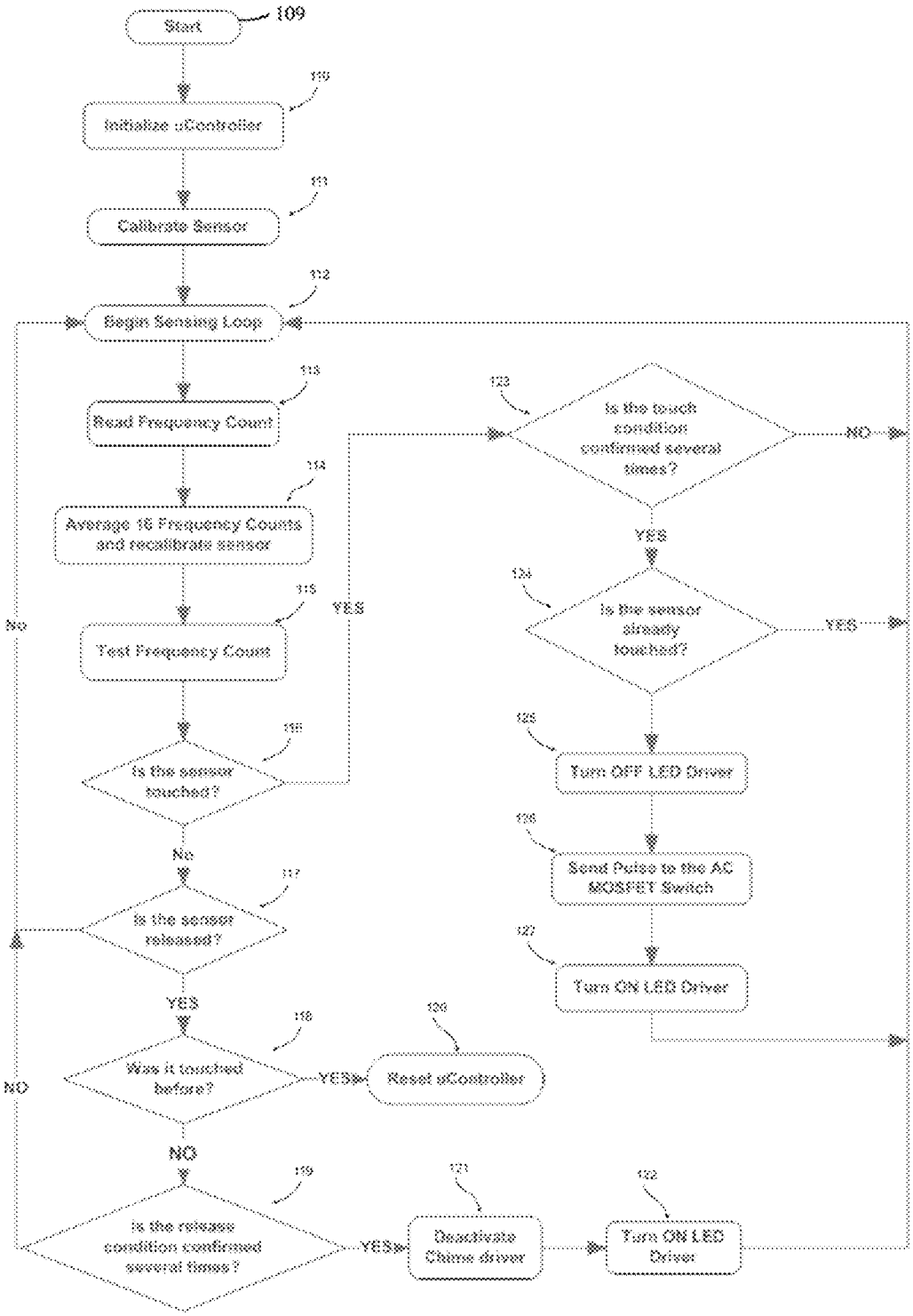

Referring to FIG. 10, a broad flowchart of the system's operation is depicted. The sysem starts at step 109, and then initializes the microcontroller in step 110 for proper operation (modules, RAM, ports, interrupts, registers). Then the system runs the calibration routine in step 111 during which the system swiftly compensates the operating conditions so that it achieves maximum sensitivity. Immediately after the system jumps into the Sensing Loop in step 112 which loops indefinitely until a touch or release condition is detected.

The first step after beginning the Sensing Loop in step 112 is to acquire the current frequency in step 113 and then to average this frequency in step 114. The averaging routine ins tep 114 compensates any environmental changes such as water droplets from rain or moisture or frost to maintain proper operation. Then the system tests the current frequency in step 115 to detect a touch. If the sensor is touched in step 116 it jumps into a filtering routine in step 123 to filter out false triggering. If a false triggering is detected the program goes back to the beginning of the sensing loop step 112. If no false triggering, the system checks if it was already touched in step 124 and if it was touched the system goes back to the beginning of the sensing routine of step 112 without taking any further action. Otherwise the system turns off the LED driver in step 125 to preserve power and sends a pulse to the AC MOSFET switch in step 126 of predetermined duration to activate the chime solenoid. Then the turns ON the LED driver in step 127 and goes back to the beginning of the sensing loop in step 112

If during the testing of the frequency count in step 115 the system does not recognize a touch, it tests for a release condition in step 117. If no release condition is detected in step, the program goes back to the beginning step 112 to again enter of the sensing. If a release condition is detected in step 117, then the system checks whether this condition follows a touch condition in step 118 and if it does then it resets itself in step 120. This reset forces the system to swiftly recalibrate to the new conditions. If the release condition does not follow a touch condition then the sytem jumps to a filtering routine in step 119 to filter out false release condition detections. If a false release condition is detected, the system goes back to the beginning of the sensing loop step 112. Otherwise the system deactivates the chime driver (AC MOSFET Switch 17) in step 121, turns ON the LED driver in step 122, and then returns to the beginning sensing loop step 112.

The following are materials used for particular reference numerals in a preferred embodiment:

1: Input terminals KEYSTONE 8191 SCREW_TERMINAL
3: Microchip PIC12F615T-I/SN SOIC 8-Pin FLASH-Based CMOS Microcontrollers
9: MB8S Bridge Rectifier SOIC-4
10: 220 UuF 35V Electrolytic Capacitor
11: 1 KOhm R1206
12: 0.1 uF 16V 0603 MLCC Capacitor
13: DNBT8105-7 SOT23-BEC-NPN Transistor
14: ASMT-UWB1-NX3G2 WARM WHITE 3500K
15: 1 KOhm R0805
16: 100 Ohm R1206
17: IRLML0060TRPBF N-Channel Power MOSFET
18: 1 MOhm R0805
19: 10 pF 50V 0805 MLCC Capacitor
20: 12 KOhm R0805
21: 20 Ohm R0805
22: MMBT2222A SOT23 NPN Transistor
23: 100 KOhm R0805
24: 68 KOhm R0805
25: 1 pF 16V 0603 MLCC Capacitor
26: MBRA140TRPBF Schottky Diode 403D
29: 220 Ohm R0805
31: 5.1V 0.5 W Zener Diode MiniMELF
33: LL4148 Small Signal Diode MiniMELF
34: 1.5 KOhm R0805
35: 2.2 KOhm R0805

The current configuration provides zero-force actuation for a chime bell touch button using capacitive touch technology to sense a touch. The device is sensitive enough to sense a touch through a glove or other clothing, from any part of the human body making it user friendly for handicap people. When a touch is sensed only one short pulse is generated to ring the chime bell, such that the chime bell circuit including the transformer and the chime bell are protected from overload as could happen from a jammed chime button. The device has a metallic housing, a metallic base and a printed circuit board ("PCB"). The metal housing provides the touch pad, and it has an electrically-insulating layer to protect the sensitive electronics from Electro-Static Discharge ("ESD"). The metal housing is preferably is fixed to the metallic base with one screw which is used to electrically connect the metallic housing with the metallic base. The is fixed on the metallic base with a plurality of screws which electrically connect the PCB touch terminals with the metallic base. Mounted to the PCB are a microcontroller, a large capacitor, a mosfet AC switch, a plurality of LEDs and a plurality of the other electronic parts described herein. A large capacitor is charged from the chime bell circuit. When the device is not touched, the microcontroller is powered from the chime bell circuit. When the device is touched, the microcontroller and the mosfet AC switch are powered from the large capacitor for the duration of the ring-pulse. When the device is not touched, the LEDs are bright to indicate the chime button. When the device is touched, the LEDs are automatically turned off to drop down the power consumption from the large capacitor.

Although the preferred embodiment has been described in detail, it should be understood that various changes, substitutions and alterations can be made therein without departing from the spirit and scope of the invention as defined by the appended claims.

What is claimed is:

1. An illuminated doorbell chime comprising:

a main power supply;

one or more LED lights;

a chime having a chime coil;

a circuit having a power supply unit, an LED driver and a chime driver, wherein said power supply unit is connected to said one or more LED lights and said chime coil, said LED driver is connected to said one or more LED lights, and said chime driver is connected to said chime coil;

a touch pad doorbell sensor having a touch surface defined by a housing of an outdoor portion of said doorbell chime;

said touch pad doorbell sensor further including an RC circuit which includes a capacitor and a resistor connected in parallel to an earth ground, with said touch surface connected to said capacitor and said resistor of said RC circuit such that when said touch surface is touched by a person, the person defines a capacitance connecting between said touch surface and the earth ground in parallel with said capacitor and said resistor; and a microprocessor programmed for discriminating against touches to said touch surface caused by moisture and small animals, as opposed to a human touch, wherein said microprocessor is connected to said RC circuit to both determine voltage on said RC circuit and to selectively apply a voltage to said RC circuit, and said microprocessor compares a measured relaxation frequency of said RC circuit to a threshold relaxation frequency for determining when the human touch has occurred.

2. The illuminated doorbell chime according to claim 1, further comprising said microprocessor having a comparator with a comparator input and a comparator output, said comparator output being selectively controlled by said microprocessor to be disposed in a low voltage state and to be disposed in a high voltage state, wherein when said comparator output is in said high voltage state said capacitor of said RC circuit charges and when said comparator output is in said low voltage state said capacitor of said RC circuit discharges to the earth ground through both said resistor of the RC circuit and through the person when touching said touch surface.

3. The illuminated doorbell chime according to claim 2, wherein said comparator output goes from a low state to a high state when a predetermined low voltage is detected at said comparator input and resets to a low state when a predetermined high voltage is detected at said comparator input.

4. The illuminated doorbell chime according to claim 1, wherein said LED driver has an LED driver transistor with a base of said LED driver transistor connected to a LED output of said microprocessor, and said LED output is pulled to a high voltage state to power on said LED lights, and moved to a low voltage state to turn off said LED lights.

5. The illuminated doorbell chime according to claim 1, wherein said chime driver has a chime driver transistor having a base connected to a chime driver output of said microprocessor, and said chime driver transistor is connected to a chime switch for selectively applying AC power to the chime coil.

6. The illuminated doorbell chime according to claim 5, further comprising and second RC circuit to provide a delay for avoiding accidental triggers when powering up or powering down said illuminated doorbell chime.

7. The illuminated doorbell chime according to claim 5, wherein said switch comprises one or more MOSFETS having respective gates connected to said chime driver transistor.

8. The illuminated doorbell chime according to claim 1, further comprising an electrolytic capacitor which powers said microprocessor when said driver circuit is applying power to said chime coil, said capacitor connected between ground and a power output of said main power supply.

9. The illuminated doorbell chime according to claim 8, wherein power is not applied to said LED lights when said chime coil is being powered.

10. An illuminated doorbell chime comprising:

a main power supply;

one or more LED lights;

a chime having a chime coil;

a circuit having a power supply unit, an LED driver and a chime driver, wherein said power supply unit is connected to said one or more LED lights and said chime coil, said LED driver is connected to said one or more LED lights, and said chime driver is connected to said chime coil;

a touch pad doorbell sensor having a touch surface of an outdoor portion of said doorbell chime;

said touch pad doorbell sensor further including an RC circuit which includes a capacitor and a resistor connected to a node and in parallel to an earth ground, and said touch surface is connected to said node and said capacitor and said resistor of said RC circuit, such that when said touch surface is touched by a person, the person defines a capacitance connecting said touch surface to the earth ground in parallel with said capacitor and said resistor; and a microprocessor having an input and an output, wherein said input is connected to said node for detecting voltage on said node, and said output is connected to said node for applying a voltage to said node, wherein said voltage is selectively applied to said node when a low voltage value is detected at said input and then said voltage is removed once a high voltage value is detected; and wherein said microprocessor includes a counter which measures a length of time for said capacitor to discharge to ground to said low voltage value, and from said length of time determines a measured relaxation frequency of said RC circuit, and compares said measured relaxation frequency to a threshold relaxation frequency for determining when the human touch has occurred and discriminating against touches to said touch surface caused by moisture and small animals.

11. The illuminated doorbell chime according to claim 10, wherein said microprocessor has a comparator with a comparator input providing said input and a comparator output providing said output, said comparator output being selectively controlled by said microprocessor to be disposed in a low voltage state and to be disposed in a high voltage state, wherein when said comparator output is in said high voltage state said capacitor of said RC circuit charges and when said comparator output is in said low voltage state said capacitor of said RC circuit discharges to the earth ground through both said resistor of the RC circuit and through the person when touching said touch surface.

12. The illuminated doorbell chime according to claim 10, wherein said LED driver has an LED driver transistor with a base of said LED driver transistor connected to a LED output of said microprocessor, and said LED output is pulled to a high voltage state to power on said LED lights, and moved to a low voltage state to turn off said LED lights.

13. The illuminated doorbell chime according to claim 10, wherein said chime driver has a chime driver transistor having a base connected to a chime driver output of said microprocessor, and said chime driver transistor is connected to a chime switch for selectively applying AC power to the chime coil.

14. The illuminated doorbell chime according to claim 13, further comprising and second RC circuit to provide a delay for avoiding accidental triggers when powering up or powering down said illuminated doorbell chime.

15. The illuminated doorbell chime according to claim 13, wherein said switch comprises one or more MOSFETS having respective gates connected to said chime driver transistor.

16. The illuminated doorbell chime according to claim 10, further comprising an electrolytic capacitor which powers said microprocessor when said driver circuit is applying power to said chime coil, said capacitor connected between ground and a power output of said main power supply.

17. The illuminated doorbell chime according to claim 10, wherein power is not applied to said LED lights when said chime coil is being powered.

* * * * *